US005803259A

United States Patent [19]

Riedel

[11] Patent Number: 5,803,259

[45] Date of Patent: Sep. 8, 1998

[54] PACKAGE FOR PHOTOGRAPHIC FILMS

[75] Inventor: Gerd Riedel, München, Germany

[73] Assignee: Agfa-Gevaert AG, Germany

[21] Appl. No.: 741,367

[22] Filed: Oct. 30, 1996

[30] Foreign Application Priority Data

Nov. 8, 1995 [DE] Germany ..... 195 41 560.4

[51] Int. Cl.[6] ..... B65D 85/672

[52] U.S. Cl. ..... 206/455; 206/394; 220/4.27

[58] Field of Search ..... 206/316.1, 389, 206/391, 394, 455; 215/6; 220/4.26, 4.27

[56] References Cited

U.S. PATENT DOCUMENTS

| | | | |
|---|---|---|---|
| 2,077,219 | 4/1937 | Conner | 215/6 |
| 2,326,414 | 8/1943 | Thompson | 220/4.27 |
| 2,833,436 | 5/1958 | Ruderian | 215/6 |
| 3,485,416 | 12/1969 | Fohrman | 220/4.27 |
| 3,490,578 | 1/1970 | Speakman et al. | 206/52 |
| 4,148,395 | 4/1979 | Syracuse et al. | 206/414 |
| 4,444,324 | 4/1984 | Grenell | 215/6 |
| 4,598,832 | 7/1986 | Alonso | 220/4.27 |
| 4,964,513 | 10/1990 | Ingram et al. | 206/459 |
| 5,370,227 | 12/1994 | Shibazaki et al. | 206/391 |

FOREIGN PATENT DOCUMENTS

| | | | |
|---|---|---|---|
| 2135710 | 11/1972 | France . | |
| 750070 | 6/1956 | Germany | 206/316.1 |
| 4437 258 A1 | 4/1995 | Germany . | |
| 4437258 | 4/1995 | Germany . | |
| 92/09499 | 6/1992 | WIPO . | |

*Primary Examiner*—Jimmy G. Foster
*Attorney, Agent, or Firm*—Connolly & Hutz

[57] ABSTRACT

A package for film cartridges in the form of a canister which consists of the following parts:

a) n hollow cylinders, b) 2 end caps and c) n−1 connecting elements, wherein n means an integer, all the parts have the same cross-section, the hollow cylinder is taller than both the end caps and the connecting elements, the hollow cylinder is positively connected, on the one hand, with the end caps and, on the other hand, with the connecting elements, where these are present, and the external diameter of the end caps and the connecting elements is no smaller than the diameter of the hollow cylinder, is stackable and may be produced rapidly and with economies of material.

10 Claims, 1 Drawing Sheet

PACKAGE FOR PHOTOGRAPHIC FILMS

This invention relates to a package for film cartridges.

135 format films are enclosed in approximately cylindrical cartridges of a diameter of some 2.5 cm. The mouth of the cartridge juts out from the circular cross-section. At this point, the cartridge measures approximately 3 cm in diameter. These film cartridges are conventionally packaged in cylindrical canisters consisting of two parts, a substantially cylindrical canister provided with a bottom and a lid which fits the canister, wherein the canister has an internal diameter slightly larger than 3 cm.

A new type of film cartridges for the Advanced Photo System differs from this and has a substantially oval cross-section (see FIG. 3).

DE 44 37 258 has already proposed a plastic case comprising a casing body with a closed bottom and a lid to be placed on the open end of the casing body for this new type of cartridge, in which casing the casing body, at least in the area in which it connects with the lid, is of such a horizontal circumference that it consists of at least four arcs of a circle joined together in series, at least two of the arcs differing from each other with regard to their radius.

With the exception of its cross-section, this package does not differ from conventional canisters.

Such canisters are conventionally produced from plastic which may be coloured black in order to protect the photosensitive film located in the cartridge from light.

The canister is usually produced from a very rigid plastic and the lid from a very flexible plastic. This ensures that the lid closes well and the contents of the canister are protected from ingress of moisture.

This plastic canister containing the film cartridge is in turn packed in a cuboidal folded cardboard box which has an original closure. Both here and in the remainder of the specification, an original closure is taken to be a closure which is discernibly changed when first opened, for example damaged, so that an unchanged, undamaged closure assures the customer that the enclosed product is the original product. Such an original closure does not prevent the container from being reclosed.

The disadvantage of such packages is that the folded cardboard box is waste once the film has been removed, requires additional production effort, entails considerable costs due to the printing of product information thereon, makes no contribution to protecting the product and increases the volume of the product.

Repeated attempts have thus been made to dispense with such folded cardboard boxes. US Pat. No. 4,964,513 thus describes a carton-less, recyclable package for the protective packaging of a photographic film, consisting of a plastic container with an appropriately fitting plastic closure and plastic labels, which bear product information and the plastic of which may be recycled together with the plastic of the container and the closure. These labels have a very elaborate two-layered design, in order to accommodate the necessary product information in the smaller space than that available on the folded cardboard box. A label is also stuck over the closure, the label having side tabs which extend beyond the closure onto the container and are stuck over the two-layer container label. This ensures that the tabs are torn when the closure is opened, so making it evident that the container has been opened.

Further disadvantages firstly include the fact that the lid has a larger diameter than the canister and thus protrudes, so making it difficult to stack the canister on retail shelves without the folded cardboard box and, secondly that, due to its length-to-diameter ratio, the canister has long flow distances and demoulding strokes during injection moulding, and restricted heat dissipation, which results in long production times and elevated wall thicknesses.

The object of the invention is to provide a package which requires no folded cardboard box, but nevertheless has sufficient space for the production information, without having to resort to complicated solutions as described above in U.S. Pat. No. 4,964,513, and which avoids the above-stated disadvantages.

A further object is to provide a package which, in order to accommodate the differing space requirements of cartridges, may deviate from a circular cross-section without abandoning the basic principle of the closure.

A further object is to provide a package which consists of simple components and can accommodate more than one film cartridge.

These objects are achieved with a canister which consists of the following parts:

a) n hollow cylinders, b) 2 end caps and c) n−1 connecting elements, wherein n means an integer, in particular 1 to 6, all the parts have the same cross-section, the hollow cylinder is taller than both the end caps and the connecting elements, the hollow cylinder is positively connected, on the one hand, with the end caps and, on the other hand, with the connecting elements, where these are present, and the external diameter of the end caps and the connecting elements is no smaller than the diameter of the hollow cylinder.

In particular, the external diameter of the caps and connecting elements is slightly larger than the external diameter of the hollow cylinder.

In order to create the positive connection, the caps and connecting elements are pushed over the open ends of the cylinder. The connecting elements are here designed in such a manner that they connect two cylinders together. Their design preferably corresponds to that of the caps in such a manner that cylindrical surfaces, corresponding to the cylindrical surfaces of the caps, extend out from both sides of the end surfaces.

The canister according to the invention can accomnodate n film cartridges. It is preferably produced from plastic, for example by injection moulding.

The canister parts may be positively connected together by conventional snap connections. To this end, the caps and the connecting elements, for example, have an internal circumferential bead at the end of the open cylindrical surface, while the cylinders have a corresponding external circumferential groove, into which the bead of the caps or connecting element snaps.

A film is preferably additionally applied over the closed canister, which film bears the necessary product information, acts as an original closure and forms a vapour barrier in addition to that of the snap closure.

Because the canister parts are shorter than hitherto conventional canisters, they may be injection moulded with thinner walls. In addition to economies of material, this results in shorter cycle times during production of the canister parts.

The canister is enclosed in a film using known methods; advantageously in such a manner that the user may readily tear it open.

The canister may be stacked in conventional retail shelves.

The canister parts may be made of identical material, for example polyethylene, polypropylene or polystyrene. This facilitates reutilisation of the material.

The figures show embodiments of the invention.

FIG. 1 shows the hollow cylinder (1) and the caps (2) which are positively connected together by means of the circumferential bead (3) on the inside of the cap wall and the circumferential groove (4) on the outside of the cylinder wall.

Figure 2:
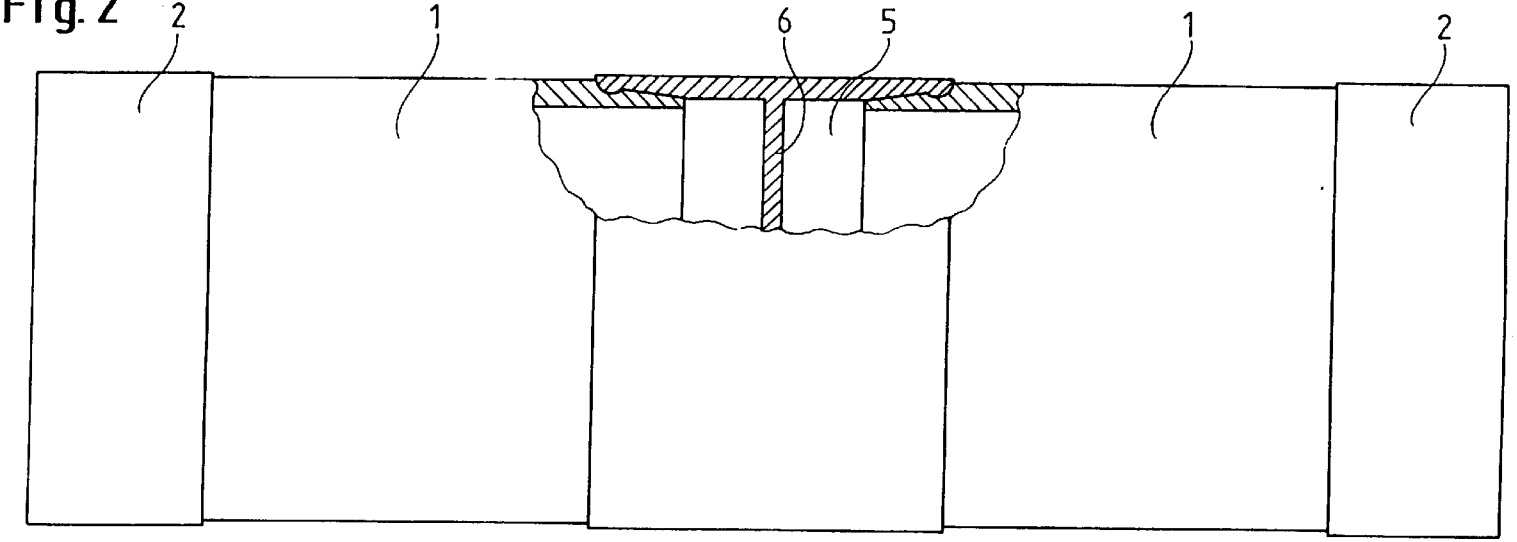
FIG. 2 shows a plan view of a package according to the invention for two film cartridges, in which a section of the external surfaces has likewise been cut away.

FIG. 2 shows two hollow cylinders (1), two caps (2) and the connecting element (5), wherein (3) and (4) again denote circumferential beads and circumferential grooves. The connecting element (5) has a wall (6) separating the two hollow cylinders, which may be entirely or partially omitted, preferably in such a manner that only a narrow ring is formed on the inside, which prevents the cartridge from sliding from one cylinder into the other.

Figure 3:
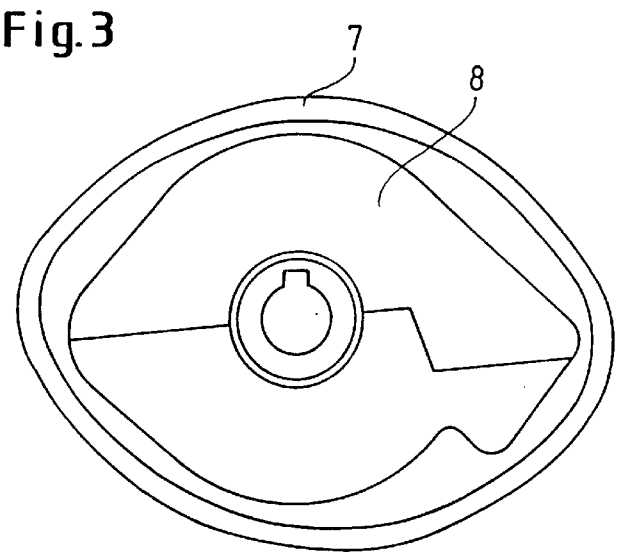
FIG. 3 shows a cross-section of a package according to the invention.

FIG. 3 shows the cross-section of a canister (7) according to the invention in an oval embodiment with a cartridge (8) inside.

Figure 1:
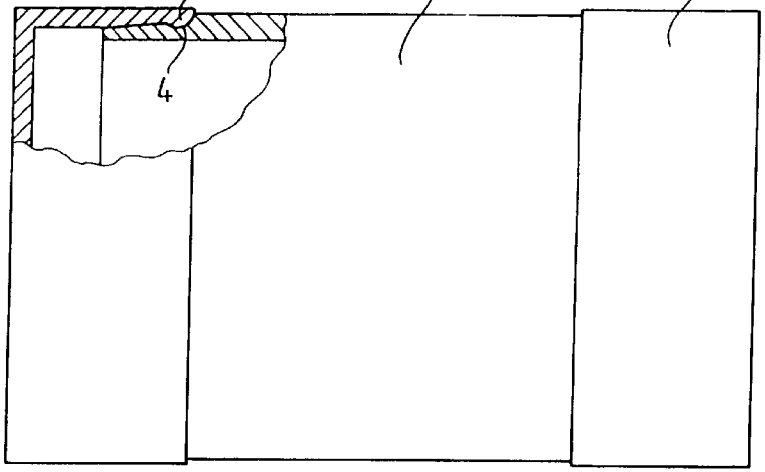
FIG. 1 shows a plan view of a package according to the invention for a single film cartridge, in which a section of the external surface has been cut away.

As may be seen from FIGS. 1 and 2, in a preferred embodiment, the wall thickness of the cap wall or connecting element wall reduces continuously towards the bead (3), as does the wall thickness of the hollow cylinder from the groove (4) to the end, in order, on the one hand, to facilitate opening and closing of the canister and, on the other hand, to minimise the difference between the external diameters of the caps and connecting elements on the one hand and the hollow cylinders on the other.

The cross-section of the canister may vary, for example being oval, as in FIG. 3, but also round, polygonal, for example rectangular, pentagonal, hexagonal or octagonal or irregularly shaped, wherein the canister cross-section is preferably selected in such a manner that it is, to a certain extent, adapted to the cross-section of the cartridge and the canister is readily stackable.

In a preferred embodiment, the external surface of the hollow cylinder is provided with structures which improve handling characteristics during opening.

I claim:

1. Film cartridges containing package in the form of a canister which consists essentially of the following parts:

a. n hollow cylinders, b. 2 end caps, c. n−1 connecting elements and d. n film catridges, wherein n means an integer 2 to 6, the hollow cylinders are taller than both the end caps and the connecting elements, the hollow cylinders are positively connected with the end caps and with the connecting elements, the external diameter of the end caps and the connecting elements is no smaller than the diameter of the hollow cylinders and said film cartridges are in the hollow cylinders so that one film cartridge is located in each hollow cylinders.

2. The film cartridge containing package according to claim 1, wherein the external diameter of the caps and connecting elements is slightly larger than the external diameter of the hollow cylinders.

3. The film cartridges containing package according to claim 1, wherein the end caps and connecting elements are pushed over the open ends of the cylinders.

4. The film cartridges containing package according to claim 1, wherein the connecting elements connect two cylinders together.

5. The film cartridges containing package according to claim 4, wherein cylindrical surfaces of the caps extend out from both sides of the end surfaces.

6. The film cartridges containing package according to claim 5, wherein said canister is plastic.

7. The film cartridges containing package according to claim 2, wherein the end caps and connecting elements are pushed over the open ends of the cylinders.

8. The film cartridges containing package according to claim 2, wherein the connecting elements connect two cylinders together.

9. The film cartridges containing package according to claim 8, wherein cylindrical surfaces of the caps extend out from both sides of the end surfaces.

10. The film cartridges containing package according to claim 9, wherein said canister is plastic.

* * * * *